US012259155B2

(12) United States Patent
Tang et al.

(10) Patent No.: US 12,259,155 B2
(45) Date of Patent: Mar. 25, 2025

(54) AIR PURIFIER

(71) Applicant: Shenzhen Chenbei Technology Co., Ltd., Shenzhen (CN)

(72) Inventors: Yu Tang, Shenzhen (CN); Yingchun Zhang, Shenzhen (CN)

(73) Assignee: SHENZHEN CHENBEI TECHNOLOGY CO., LTD., Shenzhen (CN)

( * ) Notice: Subject to any disclaimer, the term of this patent is extended or adjusted under 35 U.S.C. 154(b) by 668 days.

(21) Appl. No.: 17/616,664

(22) PCT Filed: Aug. 7, 2020

(86) PCT No.: PCT/CN2020/107977
§ 371 (c)(1),
(2) Date: Dec. 5, 2021

(87) PCT Pub. No.: WO2022/027663
PCT Pub. Date: Feb. 10, 2022

(65) Prior Publication Data
US 2022/0333796 A1 Oct. 20, 2022

(51) Int. Cl.
*F24F 3/16* (2021.01)
*F24F 8/108* (2021.01)
(Continued)

(52) U.S. Cl.
CPC ..... *F24F 3/16* (2013.01); *F24F 13/085* (2013.01)

(58) Field of Classification Search
CPC .. F24F 3/16; F24F 8/108; F24F 13/085; F24F 13/08; F24F 13/24
(Continued)

(56) References Cited

U.S. PATENT DOCUMENTS 4,731,101 A * 3/1988 Kanda ..... B04C 5/10 55/472
5,641,343 A * 6/1997 Frey ..... B01D 46/521 55/330

(Continued)

FOREIGN PATENT DOCUMENTS

CN 108369024 * 8/2018 ..... F24F 13/06
KR 20070090396 * 9/2007 ..... F04D 29/30
KR 101329480 * 11/2013 ..... F04D 29/30

*Primary Examiner* — Minh Chau T Pham
(74) *Attorney, Agent, or Firm* — Trojan Law Offices

(57) ABSTRACT

The present invention provides an air purifier which includes an outer case (10) having a filtering cavity (15) and a driving cavity (16) space apart from each other, a filter (20) received in the filtering cavity (15), a driving fan (30) received in the driving cavity (16). The outer case has at least one air inlet (17) and an air output arrangement (11). The air purifier further includes an air hub (40) provided between the filtering cavity (15) and the driving cavity (16). The air hub (40) includes a first air drawing frame (41) and a second air drawing frame (42). The first air drawing frame (41) extending within a central cavity (21) of the filter (20) and is coaxially formed with respect to the filter (20). An axial direction of the first air drawing frame (41) is aligned with a longitudinal axis of the driving fan (30). The second air drawing frame (42) peripherally, upwardly and radially extends from the first air drawing frame (41) toward an upper end of the filter (20). The first air drawing frame (41) and a second air drawing frame (42) increase total surface area for air flow and reduces air resistance and noise.

16 Claims, 10 Drawing Sheets

(51) Int. Cl.
*F24F 13/08* (2006.01)
*F24F 13/24* (2006.01)

(58) Field of Classification Search
USPC ..... 55/471–473
See application file for complete search history.

(56) References Cited

U.S. PATENT DOCUMENTS

| | | | | |
|---|---|---|---|---|
| 6,156,085 | A * | 12/2000 | Chiu | F24F 8/80 55/357 |
| 7,670,400 | B2 * | 3/2010 | Reynolds | F04D 29/626 55/467 |
| 10,940,422 | B2 * | 3/2021 | Park | B01D 46/26 |
| 11,262,091 | B2 * | 3/2022 | Kim | F24F 11/52 |
| 11,752,461 | B2 * | 9/2023 | Jeon | F24F 13/28 55/482 |
| 2012/0000356 | A1 * | 1/2012 | Moredock | B01D 45/16 55/438 |
| 2015/0128544 | A1 * | 5/2015 | Roston | B01D 45/14 55/471 |

* cited by examiner

AIR PURIFIER

BACKGROUND OF THE PRESENT INVENTION

Field of Invention

This application relates to the technical field of air purification, and specifically relating to an air purifier.

Description of Related Arts

Air purifier refers to household electrical appliances which are capable of absorbing, decomposing or converting a variety of air pollutants (generally including PM2.5, dust, pollen, odor, formaldehyde, pollutant emanating from remodeling, bacteria, allergens, etc.), and effectively improving the cleanliness of air. Air purifiers are mainly divided into household use, commercial use, industrial use, and dwelling use.

A conventional air purifier usually comprises a motor, a fan, and air filters. Its basic working principle is as follows: the motor and the fan are arranged to generate indoor air circulation, wherein various pollutants or undesirable materials in the indoor air are filtered or absorbed by the various air filters. Because indoor air must be continuously driven by the fan to circulate in an indoor space, the air purifier will generate a considerable amount of noise or annoying sound while it is working. As a result, users of conventional air purifiers may feel uncomfortable when hearing such noise or annoying sound. The noise may interfere with the users' work or life, thus adversely affecting user experience of the air purifiers.

SUMMARY OF THE PRESENT INVENTION

Technical Problems

An object of the present invention is to provide an air purifier which is designed to solve the noise problem or weird sound problem associated with conventional air purifiers.

Solutions to Resolve the Technical Problems

In order to achieve the above objects, the present invention provides:

an air purifier, which comprises an outer case having a filtering cavity and a driving cavity space apart from each other, a filter received in the filtering cavity, a driving fan received in the driving cavity; the outer case further having at least one air inlet communicating the filter with ambient environment, the air purifier further comprising an air hub between the filtering cavity and the driving cavity for letting air filtered by the filter enter the driving cavity through the air hub, the air purifier further comprising an air output arrangement communicated with the driving cavity so as to allow air in the driving cavity to be discharged out of the driving cavity through the air output arrangement;

the air hub comprising a first air drawing frame and a second air drawing frame, the first air drawing frame extending within a central cavity of the filter and being coaxially formed with respect to the filter, an axial direction of the first air drawing frame being aligned with a longitudinal axis of the driving fan, the second air drawing frame peripherally, upwardly and radially extending from the first air drawing frame toward an upper end of the filter, each of the first air drawing frame and the second air drawing frame having a plurality of air inlets evenly formed and distributed thereon.

In one embodiment, the first air drawing frame is configured as having a flat surface and is substantially perpendicular to a longitudinal axis of the filter;

or the first air drawing frame is configured to have a concave contour with respect to the driving fan;

or the first air drawing frame is configured to have a convex contour with respect to the driving fan.

In one embodiment, the second air drawing frame is configured to have form a cone-shape structure, in which a diameter of this cone-shape structure gradually increases from the first air drawing frame;

or the second air drawing frame is configured to have a convex structure with respect to a longitudinal axis of the air hub.

In one embodiment, the first air drawing frame is configured as having a flat surface and is substantially perpendicular to a longitudinal axis of the filter, the second air drawing frame being configured to have form a cone-shape structure, in which a diameter of this cone-shape structure gradually increases from the first air drawing frame;

the second air drawing frame forming an angle of inclination with respect to the filter, the angle of inclination ranges between 15° and 45°, a vertical distance between the first air drawing frame and a top end of the filter is between 35 mm to 65 mm.

In one embodiment, the air purifier further comprises an air guiding device provided in the driving cavity and positioned between the driving fan and the air output arrangement, the air guiding device being coaxially arranged with respect to the driving fan, the driving fan being configured as a centrifugal fan and comprises a plurality of first fan blades, the air guiding device comprising a plurality of second fan blades spirally distributed along the air guiding device.

In one embodiment, a direction of spiral of each of the second fan blades is opposite to that of the first fan blades.

In one embodiment, an external diameter of the first fan blades of the driving fan is smaller than an internal diameter of the second fan blades.

In one embodiment, the air guiding device comprises a mounting portion for mounting the air guiding device in the outer case, an inner boundary member extended from the mounting portion, and an outer boundary member extended from the mounting portion at a position radially outwardly from the inner boundary member, wherein the second fan blades extend between the inner boundary member and the outer boundary member.

In one embodiment, each of the second fan blades extends from the inner boundary member at a position near the corresponding first fan blade toward the outer boundary member in a curved manner such that the curvature extends toward a direction opposite to the adjacent second fan blade, the second fan blade extending from the outer boundary member at a position near the corresponding first fan blade towards the inner boundary member in a curved manner such that the curvature extends toward a direction opposite to the adjacent second fan blade.

In one embodiment, each of the second fan blades extends from the inner boundary member toward the outer boundary member in a curved manner.

In one embodiment, the air purifier further comprises a motor for driving the first fan blades to rotate, wherein a direction of rotation of the motor is opposite to a curvature direction of the first fan blades.

In one embodiment, the driving fan further comprises a supporting frame and a circumferential frame, the supporting frame and the circumferential frame being coaxially arranged and spacedly supported from each other, an external contour of a top portion of the supporting frame being corresponding to a bottom portion of the mounting portion, each of the first fan blades being mounted between the supporting frame and the circumferential frame.

In one embodiment, the air output arrangement comprises a plurality of connecting rods spirally distributed on top of the outer case, wherein a spiral distribution and orientation of the connecting rods are corresponding to that of the second fan blades, a space formed between each two connecting rods constituting an air outlet of the air purifier.

In one embodiment, each of the connecting rods is shaped and size to form an arch shape.

In one embodiment, the air output arrangement further comprises a main panel and a peripheral panel, wherein the motor and the air guiding device are supported by the main panel, the connecting rods extending between the main panel and the outer ring.

In one embodiment, the outer case further comprises a first partitioning wall provided in the driving cavity at a position between the air hub and the outer boundary member, the air driven by the driving fan is concentrated in a region between the driving fan and the first partitioning wall, which is arranged to guide the air to enter the second fan blades.

In one embodiment, the outer case further comprise a second partitioning wall and a third partitioning wall provided in the driving cavity, the second partitioning wall being positioned between the outer boundary member and the outer ring, the third partitioning wall being positioned between the inner boundary member and the main panel, air from the second fan blades being guided to flow into a region between the second partitioning wall and the third partitioning wall and eventually flow out of the outer case through the air outlets.

In one embodiment, the third partitioning wall is configured to have a curved and convex contour, wherein an internal diameter of the third partitioning wall gradually increases from the main panel toward the inner boundary member.

In one embodiment, the outer case further comprises a first tubular member, a second tubular member, and a base, wherein the first tubular member is overlapped on the second tubular member in a coaxial manner, the first tubular member being provided outside the first partitioning wall and the second partitioning wall, the second tubular member being provided outside the filter, the base being provided on the second tubular member at a position opposite to the first tubular member, the air inlets being formed on the second tubular member.

Advantageous Effects

The present invention provides an air purifier which has the advantageous effects of: the air hub of the air purifier comprises a first air drawing frame and a second air drawing frame, the first air drawing frame extending within a central cavity of the filter and being coaxially formed with respect to the filter, an axial direction of the first air drawing frame being aligned with a longitudinal axis of the driving fan, the second air drawing frame peripherally, upwardly and radially extending from the first air drawing frame toward an upper end of the filter. The first air drawing frame extends into the central cavity of the filter. As such, a total surface area for allowing air flow of the first air drawing frame and a second air drawing frame is substantially larger as compared to that of a situation where the air hub is horizontally mounted at a position between the filtering cavity and the driving cavity. Thus, the present invention substantially increases the total surface area for air flow for the air hub and therefore substantially reduces air resistance. For a given air flow volume, the present invention minimizes noise and enhances users' experience.

BRIEF DESCRIPTION OF THE DRAWINGS

In order to more clearly explain the technical solutions provided in the various embodiments of the present invention, the followings provide a brief description of the drawings used to illustrate the various embodiments of the present invention. It is obvious that the drawings presented below are merely some of the exemplary embodiments of the present invention. A person skilled in the art may derive other alternative drawings from these drawings without exercising extra inventive steps.

Wherein the above drawings may adopt the following numerals for identification of elements:

10—outer case; 11—air output arrangement; 111—connecting rod; 112—air outlet; 113—main panel; 114—peripheral panel; 12—first tubular member; 13—second tubular member; 14—base; 15—filtering cavity; 16—driving cavity; 17—air inlet; 20—filter; 21—central cavity, 30—driving fan; 31—supporting frame; 32—circumferential frame; 33—first fan blade; 40—air hub; 41—first air drawing frame; 42—second air drawing frame; 43—peripheral frame; 44—first annular member; 45—second annular member; 46—third annular member; 47—connecting member; 50—air guiding device; 51—mounting portion; 52—inner boundary member; 53—outer boundary member; 54—second fan blade; 60—motor; 70—first partitioning wall; 80—second partitioning wall; 90—third partitioning wall; 100—coupling member.

DETAILED DESCRIPTION OF THE PREFERRED EMBODIMENT

The following detailed description of the preferred embodiment is the preferred mode of carrying out the invention. The description is not to be taken in any limiting sense. It is presented for the purpose of illustrating the general principles of the present invention.

It should be appreciated that the terms "length", "width", "top", "bottom", "front", "rear", "left", "right", "vertical", "horizontal", "upper", "lower", "exterior", and "interior" in the following description refer to the orientation or positioning relationship in the accompanying drawings for easy understanding of the present invention without limiting the actual location or orientation of the present invention. Therefore, the above terms should not be an actual location limitation of the elements of the present invention. It should also be appreciated that the terms "first", "second", "one", "a", and "an" in the following description refer to "at least one" or "one or more" in the embodiment. In particular, the term "a" in one embodiment may refer to "one" while in another embodiment may refer to "more than one". Therefore, the above terms should not be an actual numerical limitation of the elements of the present invention.

The present invention will be described in details with the help of the accompanying drawings.

The present invention provides an air purifier which may is suitable to be positioned in domestic environments, in commercial buildings, or office buildings for purifying the air circulating a specific space. The noise or weird sound associated with the operation of the air purifier of the present invention may be minimized so as not to interfere with normal daily lives or work of the users of the present invention.

Figure 1:
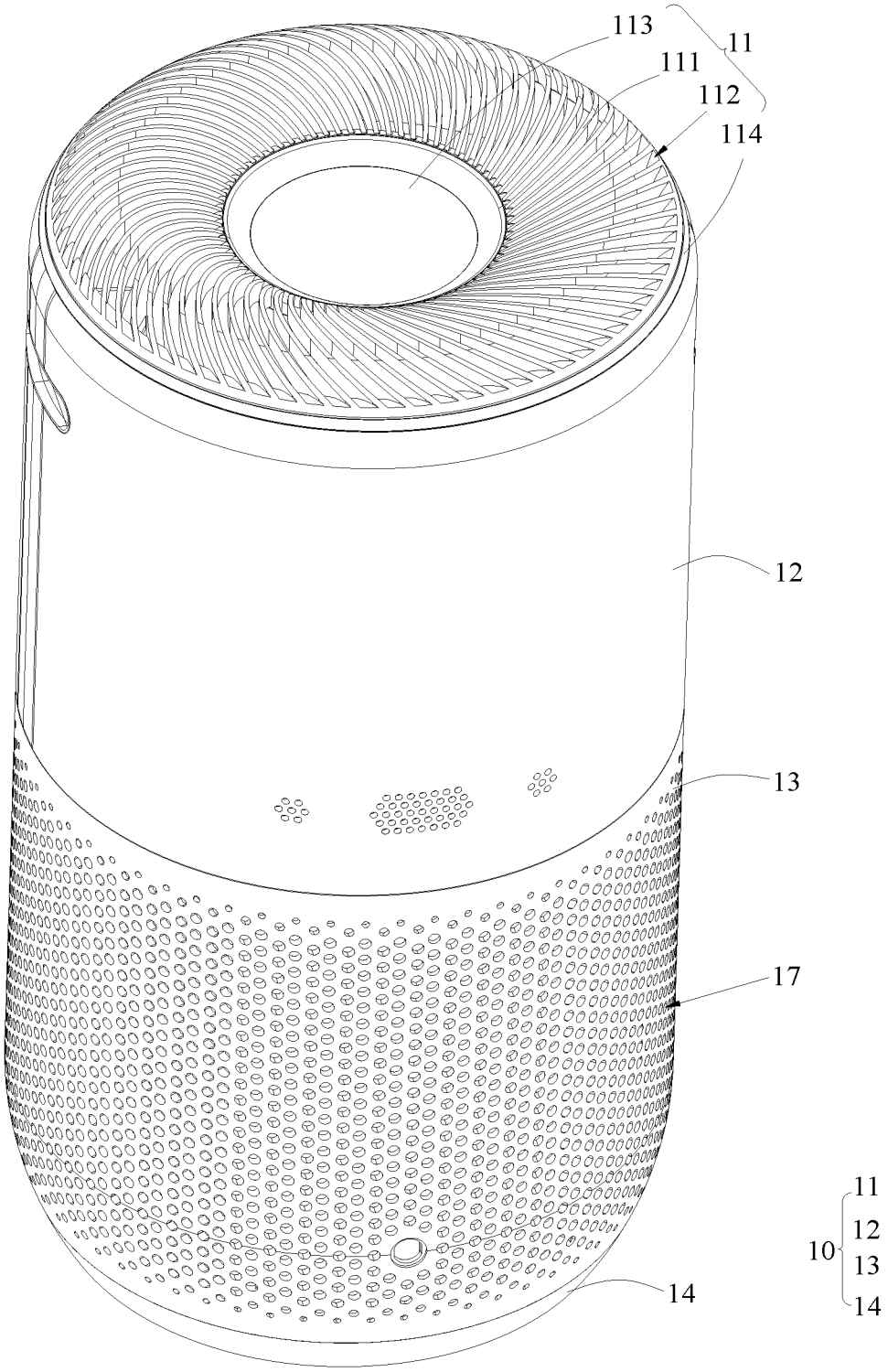
FIG. 1 is a perspective view of an air purifier according to a preferred embodiment of the present invention.
Figure 2:
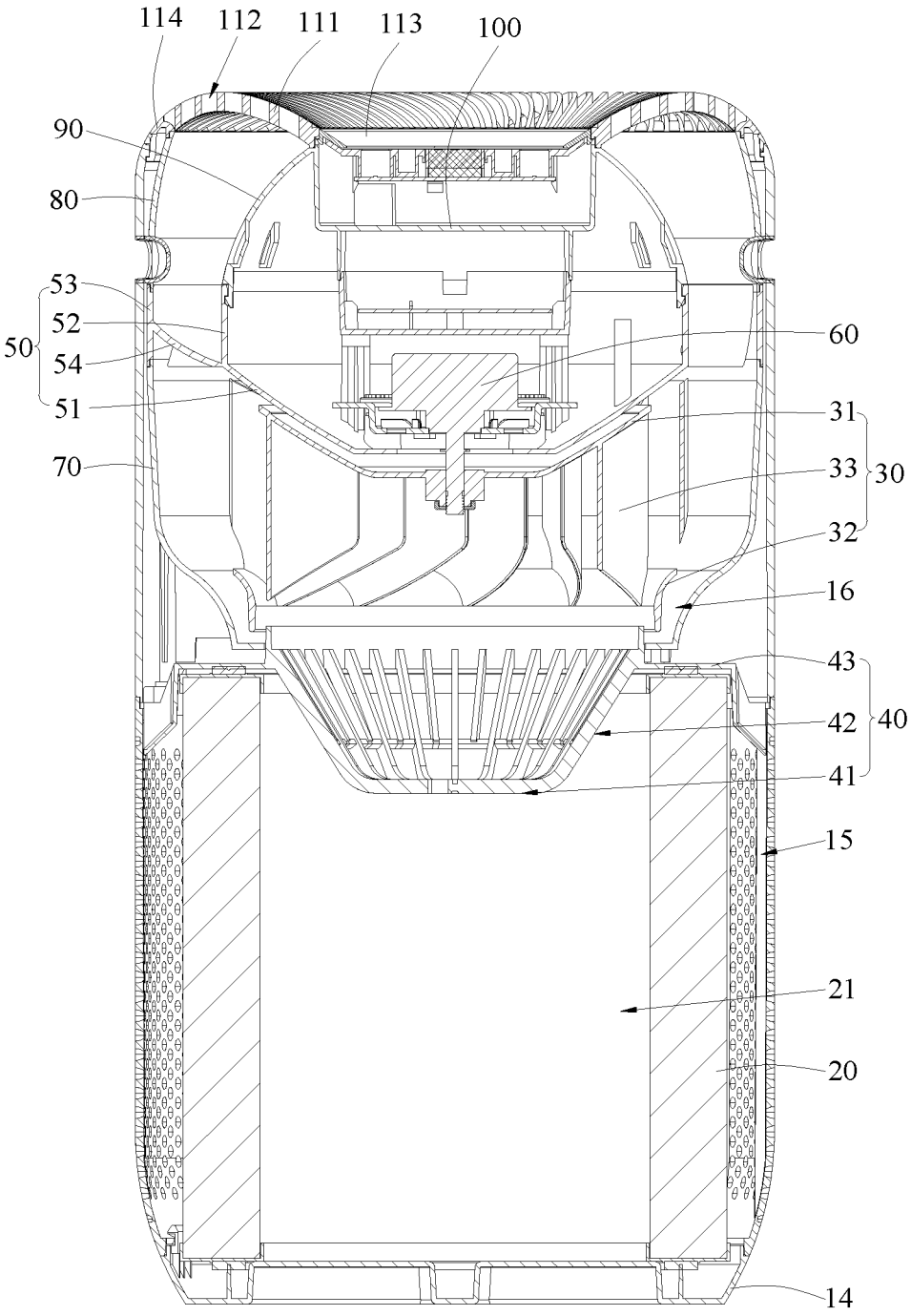
FIG. 2 is a sectional front view of the air purifier shown in FIG. 1.

Referring to FIG. 1 to FIG. 2 of the drawings, an air purifier of the present invention comprises an outer case 10 having a filtering cavity 15 and a driving cavity 16, a filter 20 mounted in the filtering cavity 15, and a driving fan 30 operatively mounted in the driving cavity 16. The outer case 10 has at least one air inlet 17 communicating the filtering cavity 15 with an exterior of the outer case 10. The air purifier further comprises an air hub 40 provided in the outer case 10 at a position between the filtering cavity 15 and the driving cavity 16, wherein air in the filtering cavity 15 may be guided to enter the driving cavity 16 through the air hub 40. Moreover, the air purifier further comprises an air output arrangement 11 provided on the outer case 10 and communicated with the driving cavity 16, wherein air in the driving cavity 16 is arranged to be discharged out of the outer case 10 through the driving cavity 16.

The outer case 10 may be configured to have a tubular structure having a circular cross-sectional shape. The filtering cavity 15 and the driving cavity 16 may be distributed in the outer case 10 along with longitudinal direction, in such a manner that when the outer case 10 stands on the ground, the driving cavity 16 is positioned above the filtering cavity 15. The driving fan 30 is arranged to generate circulation of air in the outer case 10 so as to create a suction force for driving air from ambient environment to flow into the filtering cavity 15. The air sucked into the filtering cavity 15 is arranged to pass through the filter 20 so that unwanted substances may be blocked or absorbed by the filter 20. After that, the suction force created by the driving fan 30 may continue driving the air passing through the filter 20 to enter the driving cavity 16. The air in the driving cavity 16 is arranged to be eventually discharged back to ambient environment through the air output arrangement 11.

Figure 3:
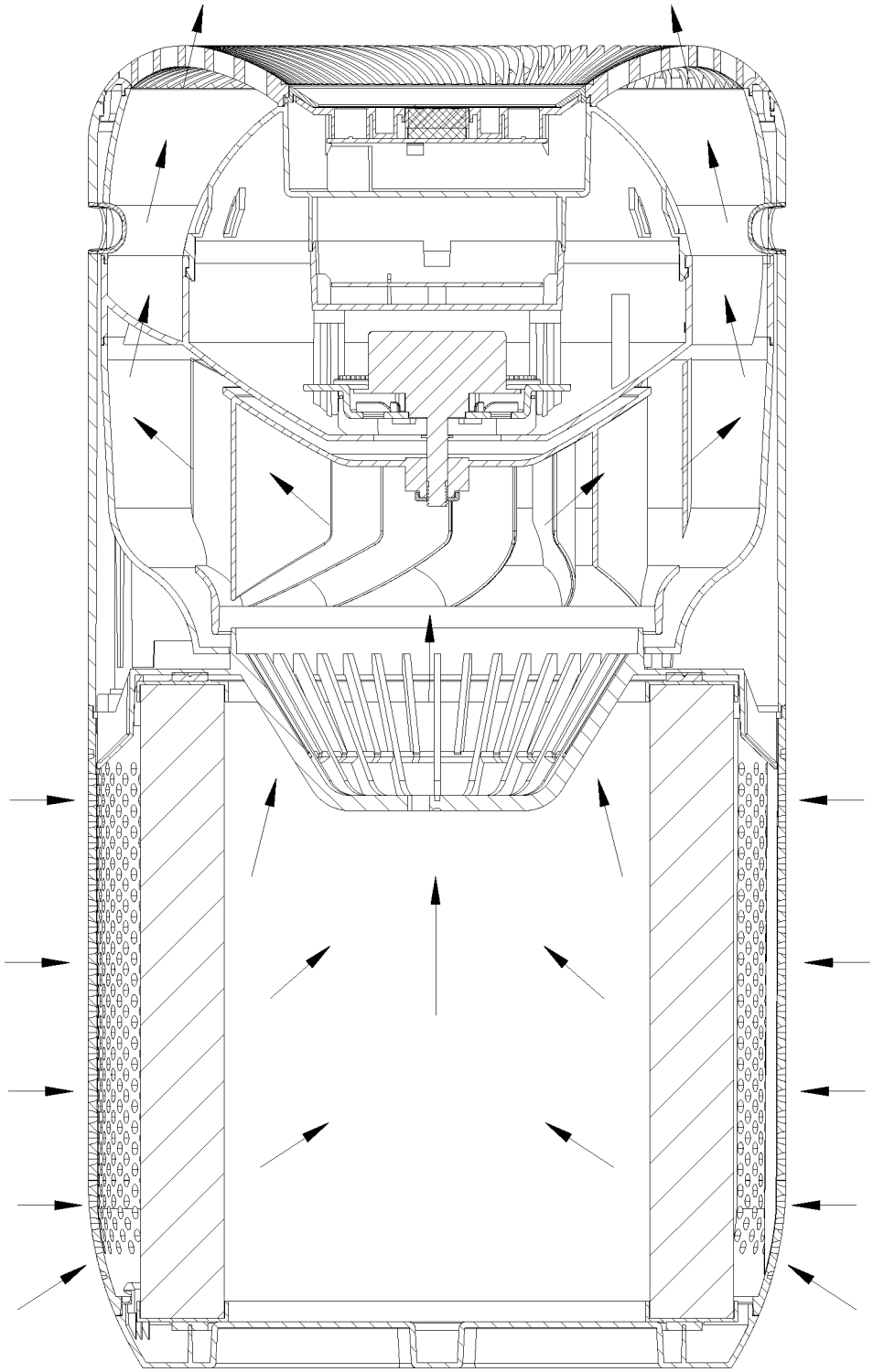
FIG. 3 is a schematic diagram of the air purifier shown in FIG. 2, illustrating a flowing path of air in the air purifier.

Referring to FIG. 2 to FIG. 3 of the drawings, the air hub 40 comprises a first air drawing frame 41 and a second air drawing frame 42, wherein the first air drawing frame 41 extends within a central cavity 21 of the filter 20. The first air drawing frame 41 is coaxially formed with respect to the filter 20, wherein an axial direction of the first air drawing frame 41 is aligned with a longitudinal axis of the driving fan 30. On the other hand, the second air drawing frame 42 peripherally, upwardly and radially extends from the first air drawing frame 41 toward near an upper end of the filter 20. It is worth mentioning that the first air drawing frame 41 and the second air drawing frame 42 are coaxially arranged meaning that the first air drawing frame 41 and the second air drawing frame 42 share a same axis. A peripheral edge of the first air drawing frame 41 is a side peripheral edge surrounding a first guiding wall 70. Each of the first air drawing frame 41 and the second air drawing frame 42 has a plurality of air inlets evenly formed and distributed thereon.

Specifically, the filter 20 is configured to have a tubular structure in which a longitudinal direction of the filter 20 is substantially aligned with a longitudinal direction of the outer case 10. The tubular structure of the filter 20 forms a central cavity 21 thereof. The air inlets 17 are distributed along the outer case 10 and positioned corresponding to an outer peripheral side wall of the filter 20. When the air purifier of the present invention is operated, air from ambient environment may be sucked into the filtering cavity 15 through the air inlets 17. The air sucked into the filtering cavity 15 is arranged to pass through the outer peripheral side wall of the filter 20 for filtering unwanted substances. Filtered air will then be arranged to enter the central cavity 21. The filtered air entering the central cavity 21 will then be driven by the driving fan 30 to enter the driving cavity 16 through the air hub 40.

Referring to FIG. 2 of the drawings, a longitudinal axis of the driving fan 30 is substantially aligned with a longitudinal axis of the first air drawing frame 41 and a longitudinal axis of the filter 20. An internal diameter of the filter 20 is smaller than an external diameter of the driving fan 30. Moreover, a diameter of the second air drawing frame 42 is smaller than the internal diameter of the filter 20. The internal diameter of the filter 20 is the diameter of the central cavity 21 thereof. As such, the air entering the central cavity 21 of the filter 20 can easily be driven by the driving fan 30 to circulate in the outer case 10.

The air purifier of the present invention provides an air hub 40 comprising the first air drawing frame 41 and the second air drawing frame 42, in which the first air drawing frame 41 is positioned in the central cavity 21 of the filter 20 and the longitudinal axis of the first air drawing frame 41 is aligned with the longitudinal axis of the driving fan 30. In other words, the first air drawing frame 41 extends from the driving cavity 16 toward the direction of the filter 20, with the second air drawing frame 42 peripherally, upwardly and radially extending from the first air drawing frame 41 toward near an upper end of the filter 20. As such, the total area in which air may pass through the air hub 40 is substantially larger than the total area in a situation where the air hub 40 merely positioned between the filtering cavity 15 and the driving cavity 16 without the construction of the first air drawing frame 41 and the second air drawing frame 42. In other words, the air hub 40 of the air purifier of the present invention serves to maximize the total area in which air may pass from the filtering cavity 15 toward the driving cavity 16 and at the same time minimize a resistance of the corresponding air flow. The result is that the noise produced by the air purifier for a given flow rate can be minimized, thus substantially enhancing user experience.

Referring to FIG. 2 of the drawings, the first air drawing frame 41 is configured as having a flat surface and is substantially perpendicular to a longitudinal axis of the filter 20. Moreover, the first air drawing frame 41 has a substantially circular cross-sectional shape in which an axis of the first air drawing frame 41 is substantially aligned with an axis of rotation of the driving fan 30. As such, the air in the central cavity 21 is allowed to be driven to enter the driving cavity 16 in a vertical manner. Since the first air drawing frame 41 has a flat surface, this structure allows maximizing the surface area in which air may flow through the first air drawing frame 41 while keeping a manufacturing difficulty and cost to the minimum. As slight variations to the preferred embodiment, the first air drawing frame 41 may be configured to have a surface of other contours or shapes, such as having a concave or convex contour with respect to the driving fan 30. These variations may as well achieve maximizing air flow and minimizing noise and manufacturing cost on the part of the air hub 40.

Referring to FIG. 2 to FIG. 5 of the drawings, the second air drawing frame 42 is configured to have a cone-shape structure, in which a diameter of this cone-shape structure gradually increases from the first air drawing frame 41 so that air entering the central cavity 21 of the filter 20 can be partially guided to flow into a gap between the filter 20 and an external surface of the second air drawing frame 42 and eventually enter the driving cavity 16 by flowing through the second air drawing frame 42. From the forgoing descriptions, one skilled in the art may appreciate that due to the inclined orientation of the second air drawing frame 42, air in the central cavity 21 can be easily guided to into the driving cavity 16 through the second air drawing frame 42. Moreover, the surface area for allowing air flowing through the second air drawing frame 42 can be maximized while minimizing the noise thus produced. The result is that the total surface area for allowing air flowing through the air hub 40 can be maximized while at the same time minimizing the noise thus produced. It is worth mentioning that the second air drawing frame 42 may also be configured to have other structures such as a curved structure or convex structure with respect to a longitudinal axis of the air hub 40. These structures can also increase the total surface area for allowing air flowing through the air hub 40 while at the same time minimizing the noise thus produced.

Figure 4:
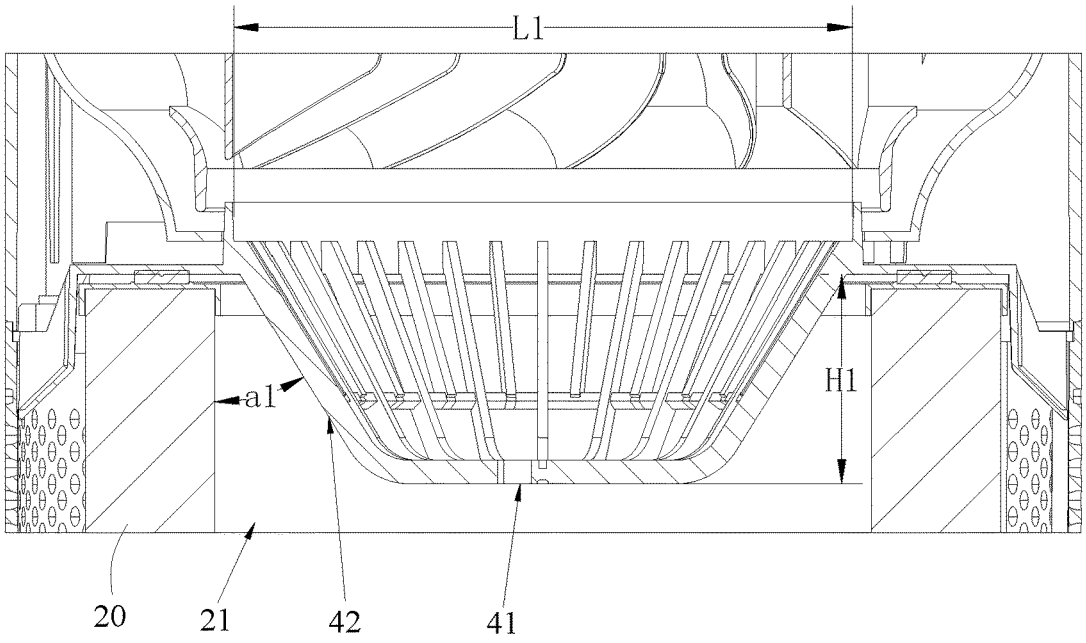
FIG. 4 is an enlarged schematic diagram of an air hub of the air purifier as shown in FIG. 2.

Referring to FIG. 4 of the drawings, the second air drawing frame 42 forms a maximum diameter L1 of 158 mm, and an angle of inclination al with respect to the filter 20 is 32°. Moreover, a vertical distance H1 between the first air drawing frame 41 and a top end of the filter is 53 mm. The total surface area of the air hub 40 for allowing air flowing therethrough is 60% more than that of the conventional arts for a given number of connecting members 47. The more the surface area for air flow, the less the air resistance produced by the air hub 40, and the more streamline the air flowing through the air hub 40. As such, for a given flow volume, the flow rate flowing through the air hub 40 can be reduced and this substantially decreases the friction between the air and its surrounding boundary and eventually substantially decreases the noise thus produced. It is worth mentioning that the diameter formed by the second air drawing frame 42 may be varied depending on the internal diameter of the filter 20. Moreover, the angle of inclination al may also be varied. Exemplary angles of inclination include 15°, 25°, 35°, or 45°. A range between 15° and 45° is considered acceptable. Similarly, the vertical distance H1 can also be varied. Exemplary vertical distances include 35 mm, 45 mm, 55 mm or 65 mm. A range between 35 mm and 65 mm is considered acceptable.

Figure 5:
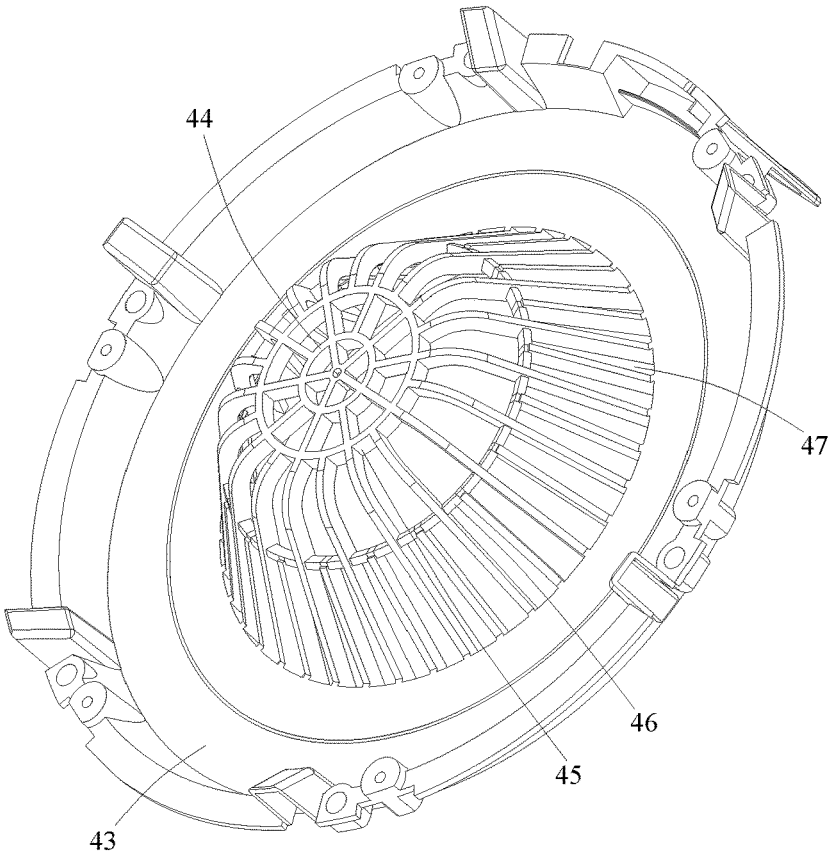
FIG. 5 is an enlarged perspective view of the air hub of the air purifier as shown in FIG. 2.

Referring to FIG. 5 of the drawings, the air hub 40 comprises a first annular member 44, a second annular member 45, a third annular member 46, and a plurality of connecting members 47. Each of the first annular member 44, the second annular member 45 and the third annular member 46 are configured to have a substantially annular shape when viewed from the top. Moreover, the first annular member 44, the second annular member 45 and the third annular member 46 are coaxially arranged in the sense that their center share a same axis. The first annular member 44 and the second annular member 45 are eccentrically arranged while the third annular member 46 is positioned above the first annular member 44 and the second annular member 45. Moreover, a diameter of the first annular member 44 is larger than that of the second annular member 45, while the diameter of the second annular member 45 is larger than that of the third annular member 46. The first annular member 45 and the second annular member 46 partially form the first air drawing frame 41, while the third annular member 46 partially form the second air drawing frame 42. The first annular member 44 is reinforced by N connecting members 47 radially extended from a center of the first annular member 44, where N is an integer. The first annular member 44 and the second annular member 45 are connected by 2×N connecting members 47. The second annular member 45 and the third annular member 46 are connected by 3×N connecting members 47. The third annular member 46 and a top end of the air hub 40 may be connected by 4×N connecting members 47. Adjacent connecting members 47 may be connected by some structural elements. The air inlets of the air hub 40 are formed by the space between the connecting members 47. The above-mentioned structure of the air hub 40 may utilize radially extending connecting members 47 to ensure adequate air passage in locations where air is mostly concentrated, and adequate structural strength in locations where air is less concentrated. The structure of the air hub 40 may also prevent user finger's from accidentally touching the driving fan 30. It is worth mentioning that the exact number of connecting members 47 may be varied. The proportion of the first annular member 44, the second annular member 45, and the third annular member 46 may also be varied.

Referring to FIG. 2 and FIG. 5 of the drawings, the air hub 40 further comprises a peripheral frame 43 extended from the second air drawing frame 42 and connected to the outer case 10 at a position above an upper end of the filter 20 so as to mount the air hub 40 on the outer case 10 through the peripheral frame 43 and to divide the outer case 10 into the filtering cavity 15 and the driving cavity 16. Thus, the peripheral frame 43 is positioned opposite to the first air drawing frame 41. Moreover, the peripheral frame 43 can also be utilized to support a first guiding wall 70 which will be described below.

Referring to FIG. 2 and FIG. 6 to FIG. 9 of the drawings, the air purifier further comprises an air guiding device 50 provided in the driving cavity 16 and connected to the outer case 10. The air guiding device 50 is positioned between the driving fan 30 and the air output arrangement 11. The air guiding device 50 is coaxially arranged with respect to the driving fan 30. The air guiding device 50 is arranged to guide the air driven by the driving fan 30 to effectively flow from the driving fan 30 toward the air output arrangement 11. The driving fan 30 is configured as a centrifugal fan and comprises a plurality of first fan blades 33 for driving air flowing in the direction away from a center of the driving fan 30. Each of the first fan blades 33 has a spiral outer contour. The air guiding device 50 comprises a plurality of second fan blades 54 spirally distributed on the air guiding device 50 and each of the second fan blades 54 also has a spiral outer contour. However, the direction of spiral of each of the second fan blades 54 is opposite to that of the first fan blades 33. For example, when the first fan blades 33 are driven to rotate in a clockwise direction, the second fan blades 54 are arranged to be spirally distributed correspondingly in an anti-clockwise direction. Conversely, when the first fan blades 33 are driven to rotate in an anti-clockwise direction, the second fan blades 54 are arranged to be spirally distributed correspondingly in a clockwise direction. In the preferred embodiment of the present invention, the first fan blades 33 are driven to rotate in a clockwise direction, while the second fan blades 54 are arranged to be spirally distributed correspondingly in an anti-clockwise direction. When the first fan blades 33 are driven to rotate, air will be driven to flow in a direction away from the center of the driving fan 30, and since the second fan blades 54 are arranged to be spirally distributed correspondingly in an anti-clockwise direction, the flow rate of the air driven by the first fan blades 33 will be reduced by the second fan blades 54 so as to minimize the noise generated when the air driven by the first fan blades 33 hits the second fan blades 54.

Figure 7:
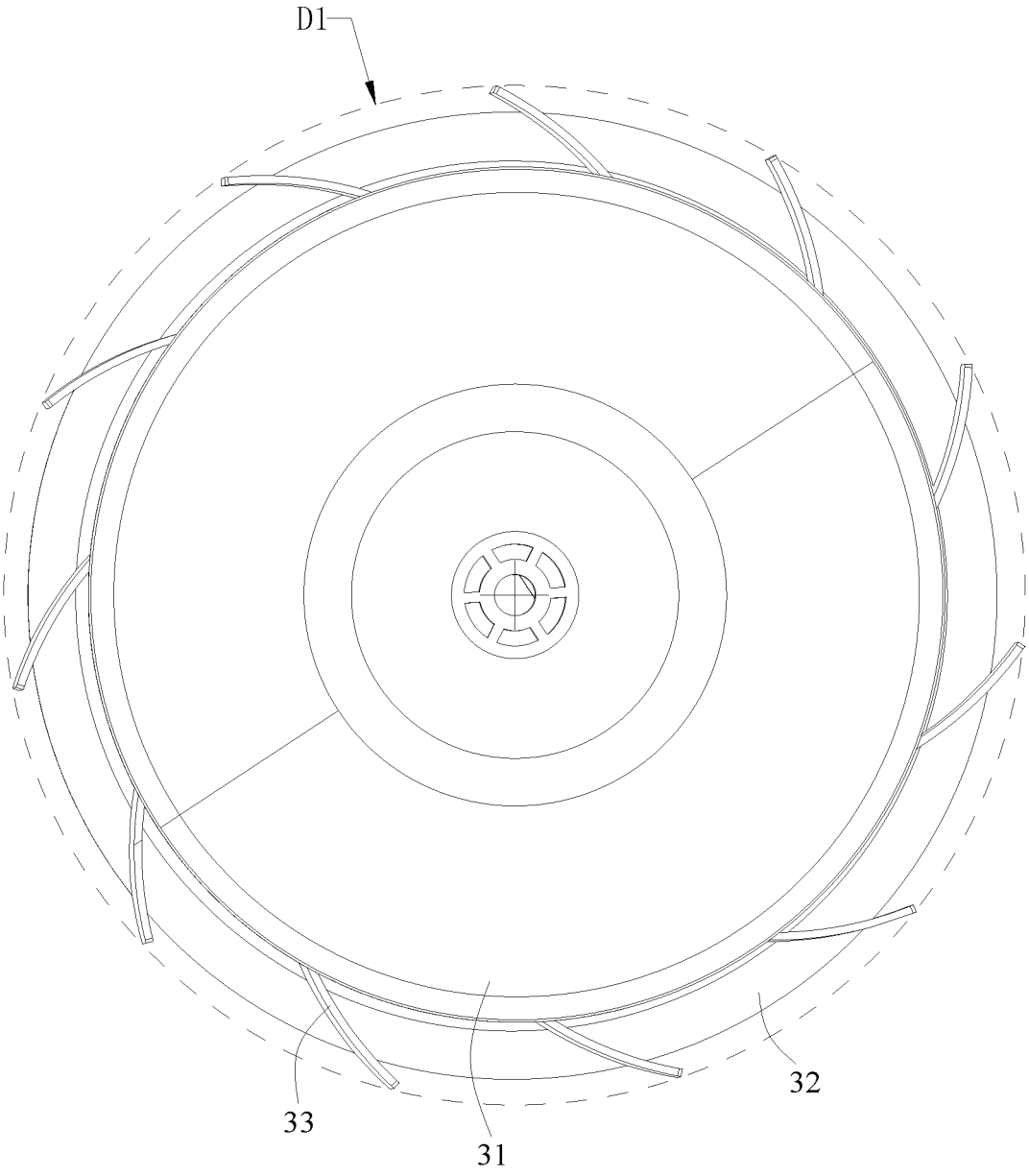
FIG. 7 is a plan view of the driving fan of the air purifier as shown in FIG. 2.
Figure 9:
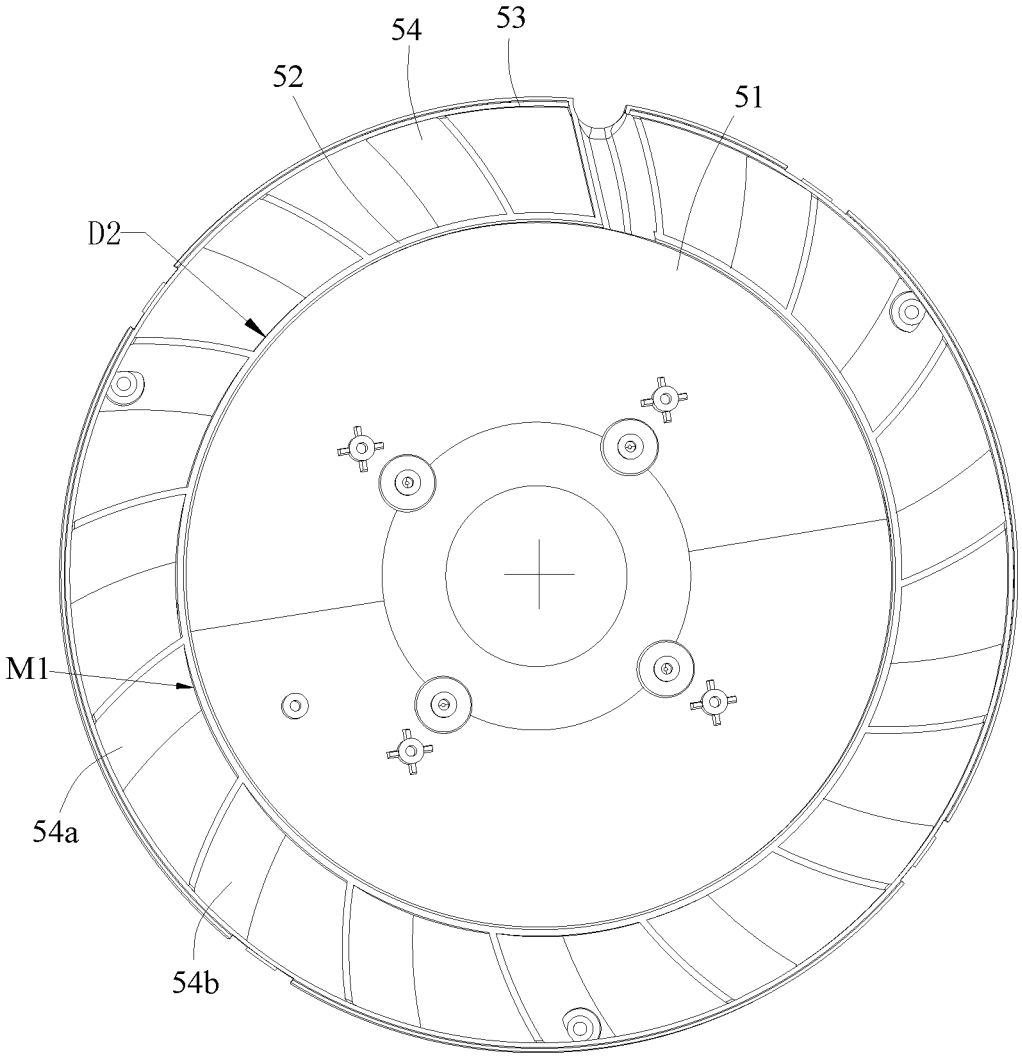
FIG. 9 is a plan view of the air guiding device of the air purifier as shown in FIG. 2.

According to the preferred embodiment of the present invention, and referring to FIG. 2, FIG. 7 and FIG. 9 of the drawings, an external diameter D1 of the first fan blades 33 of the driving fan 30 is smaller than an internal diameter D2 of the second fan blades 54. Specifically, the diameter D1 of each of the driving fan 30 is the maximum length from a center of the driving fan 30 to a peripheral edge of one of the first fan blades 33. The internal diameter D2 of the second fan blades 54 means a diameter of the imaginary circumferential edge connecting an inner edge of the second fan blades 54. When D1 is smaller than D2, the air driven by the first fan blades 33 is arranged to flow toward the second fan blades 54 so that the flow rate of the air driven by the first fan blades 33 will be reduced by the second fan blades 54. This arrangement also increases an efficiency of the air from the first fan blades 33 being diverted by the second fan blades 54.

Figure 8:
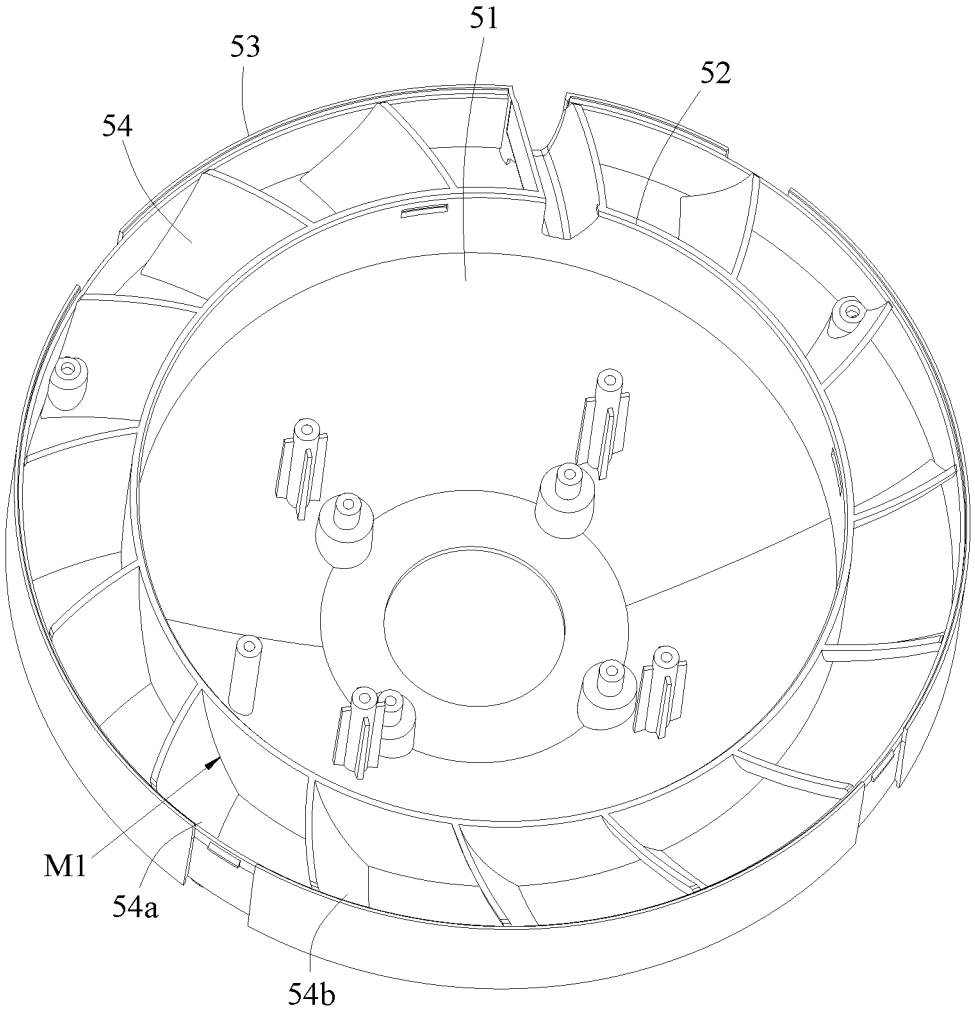
FIG. 8 is a schematic diagram of an air guiding device of the air purifier as shown in FIG. 2.

In the preferred embodiment of the present invention, and referring to FIG. 2, FIG. 8 and FIG. 9 of the drawings, the air guiding device 50 comprises a mounting portion 51, an inner boundary member 52 extended from the mounting portion 51, and an outer boundary member 53 extended from the mounting portion 51 at a position radially outwardly from the inner boundary member 52, wherein the second fan blades 54 extend between the inner boundary member 52 and the outer boundary member 53. Each of the inner boundary member 52 and the outer boundary member 53 are configured to have an annular cross-sectional shape. The mounting portion 51 is for mounting the air guiding device 50 in the outer case 10. The second fan blades 54 are secured and sandwiched between the inner boundary member 52 and the outer boundary member 53 for ensuring effective guiding of air driven from the first fan blades 33.

Referring to FIG. 8 and FIG. 9 of the drawings, each of the second fan blades 54 is distributed and oriented along an anti-clockwise direction. In other words, a particular second fan blade 54*b* is positioned frontwardly with respect to an adjacent second fan blade 54*a* along an anti-clockwise direction. Thus, the second fan blade 54*a* extends from the inner boundary member 52 at a position near the corresponding first fan blade 33 toward the outer boundary member 53 in a curved manner such that the curvature extends toward a direction opposite to an adjacent second fan blade 54*b*. In other words, the second fan blade 54*a* extends from the outer boundary member 53 towards the inner boundary member 52 in a curved manner such that the curvature extends toward a direction opposite to an adjacent second fan blade 54*b*. Specifically, a curvature of the second fan blade 54*a* may be designated as M1, wherein M1 curvedly extends from a bottom edge of the second fan blade 54*a* towards its top edge to form a contour which extends toward the center of the mounting portion 51 and along an axial direction thereof. When air from the first fan blades 33 reach the second fan blades 54, part of the air will be directed back toward the center of the mounting portion 51 so as to reduce the flow rate of air flowing through the second fan blades 54 and to allow the air flowing through the second fan blades 54 to be more streamlined, even and stable.

Referring to FIG. 9 of the drawings, each of the second fan blades 54 extends from the inner boundary member 52 toward the outer boundary member 53 with a radius of curvature of approximately 120 mm. With a curve and smooth contour, the second fan blades 54 can effectively reduce a friction between the air flowing through the second fan blades 54 and an external surface thereof so as to reduce the noise associated with air flowing through the second fan blades 54.

Referring to FIG. 2 of the drawings, the driving fan 30 further comprises a motor 60 mounted in the driving cavity 16 for driving the first fan blades 30 to rotate. In the preferred embodiment of the present invention, the direction of rotation is opposite to the curvature direction of the first fan blades 30 so that the first fan blades 30 are driven to rotate backwardly. This arrangement has the advantages of producing less vibrations and noise.

Figure 6:
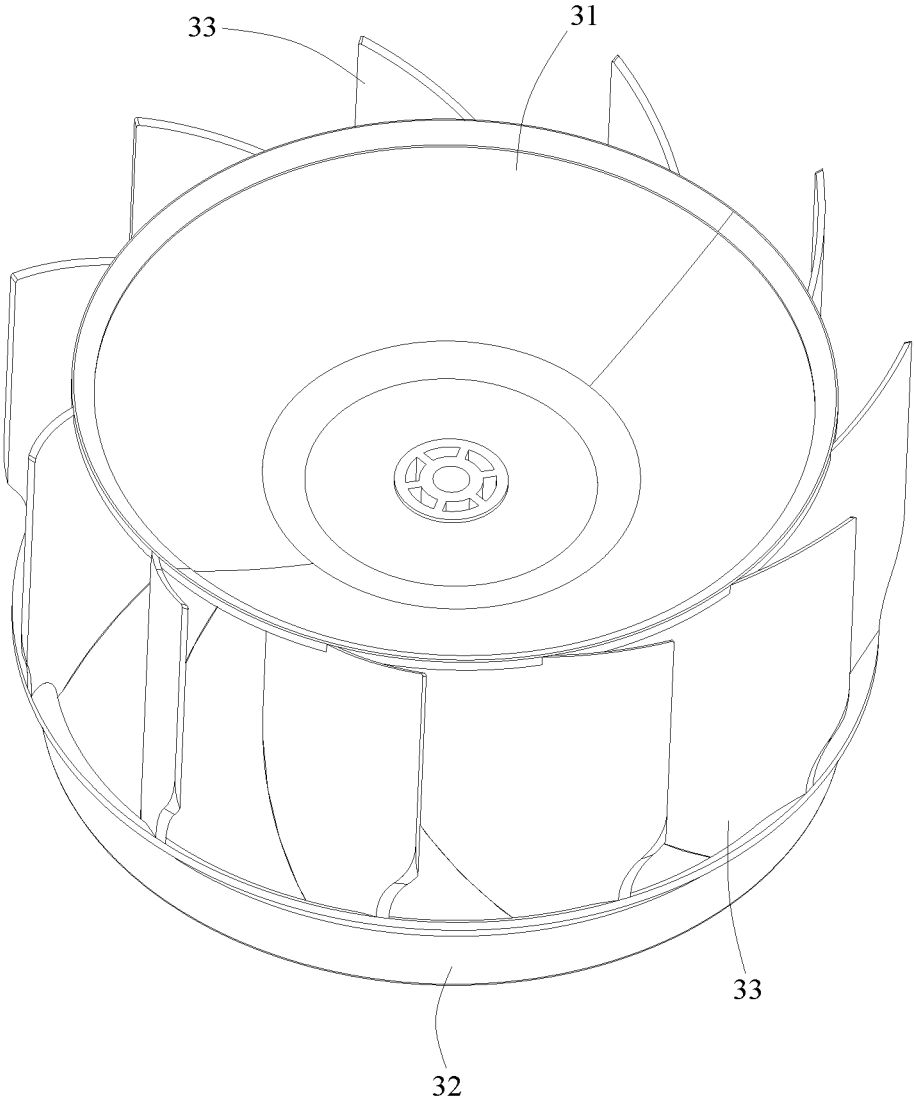
FIG. 6 is a perspective view of a driving fan of the air purifier as shown in FIG. 2.

Referring to FIG. 2, FIG. 6 and FIG. 7 of the drawings, the driving fan 30 further comprises a supporting frame 31 connected to a driving shaft of the motor 60, and a circumferential frame 32, wherein the supporting frame 31 may be driven to be rotated when the motor 60 is turned on. The supporting frame 31 and the circumferential frame 32 are coaxially arranged and spacedly supported from each other. Moreover, an external contour of a top portion of the supporting frame 31 is corresponding to a bottom portion of the mounting portion 51. Each of the first fan blades 33 is mounted between the supporting frame 31 and the circumferential frame 32. Specifically, the mounting portion 51 is configured to have a bowl shape and has generally concave contour. The supporting frame 31 is sized and shaped to correspond to the mounting portion 51. The supporting frame 31 is rotatably mounted in the mounting portion 51 which is securely mounted in driving cavity 16 of the outer case 10. The supporting frame 31 is mounted at a position above the mounting portion 51. Furthermore, since the mounting portion 51 has a bowl shape contour, the motor 60 and other components of the air purifier can be mounted on top of the mounting portion 51 in a compact manner so as to maintain a compact structure of the air purifier of the present invention.

Figure 10:
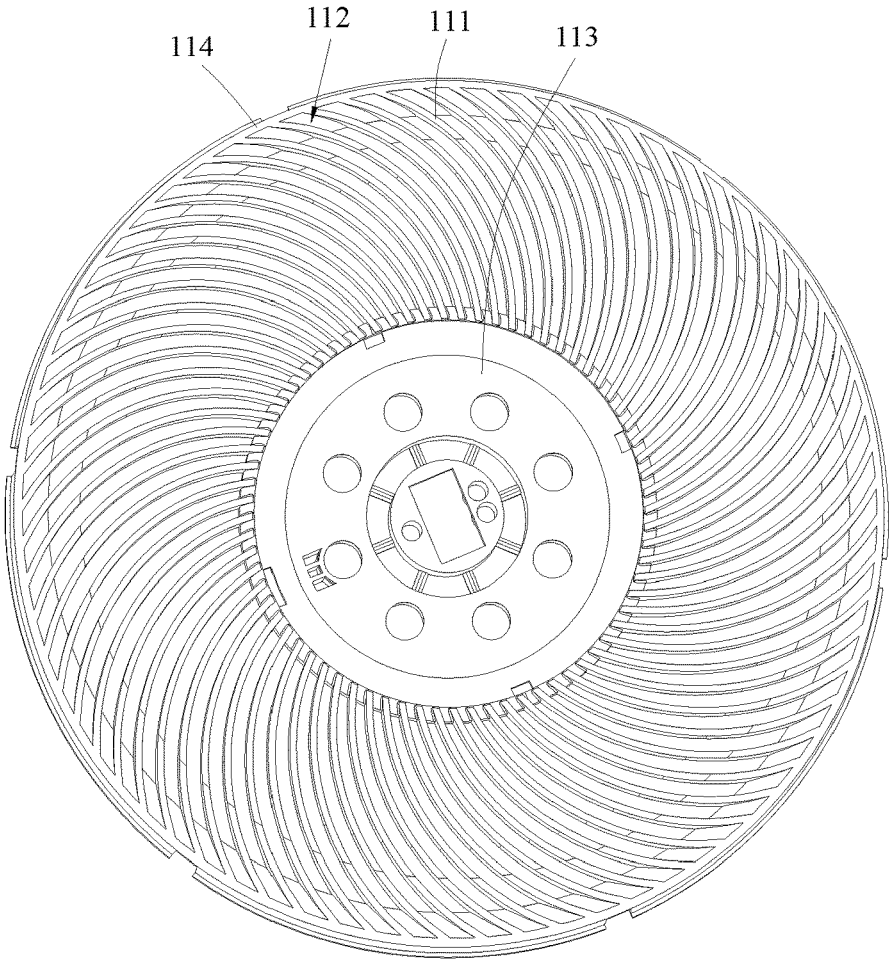
FIG. 10 is a plan schematic diagram of an air output arrangement of the air purifier as shown in FIG. 2.
Figure 11:
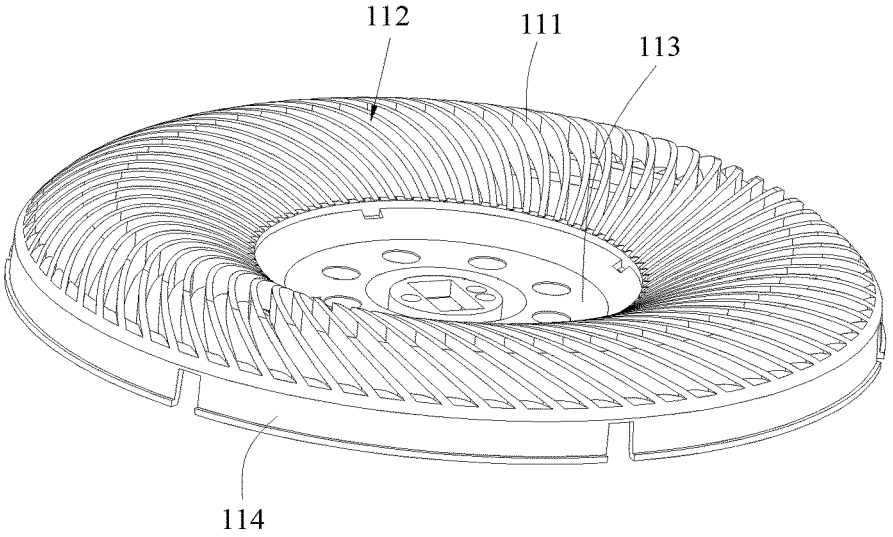
FIG. 11 is a perspective schematic diagram of an air output arrangement of the air purifier as shown in FIG. 2.

In the preferred embodiment of the present invention, and referring to FIG. 2, FIG. 10 and FIG. 11 of the drawings, the air output arrangement 11 comprises a plurality of connecting rods 111 spirally distributed on top of the outer case 10, wherein a spiral distribution and orientation of the connecting rods 111 are corresponding to that of the second fan blades 54. The space formed between each two connecting rods 111 constitute an air outlet 112 of the air purifier of the present invention. Since the spiral orientations of the connecting rods 111 and the second fan blades 54 are arranged to be substantially identical, air coming from the second fan blades 54 is arranged to be discharged out of the outer case 10 through the air outlets 112 with minimal resistance. The result is to minimize air delivering efficiency and the associated noise.

Referring to FIG. 2 and FIG. 11 of the drawings, each of the connecting rods 111 is elongated and curved in shape so as to maximize the length of each of the connecting rods 111 for a given cross-sectional area. This arrangement maximizes the total area of the air outlets 112. Since total air output (Q) can be calculated by Q=V×A, where V is air flow rate and A is cross sectional surface area through which the air flows. Thus, for a given air flow rate, increasing cross sectional surface area will increase total air output. Moreover, the larger the cross sectional surface area through which the air passes, the less the air resistance and the more stable the air flowing through the air outlets 112. Thus, for a given total air output, the flow rate passing though the connecting rods 111 can be minimized. The lower the flow rate, and lower the force exerted on the connecting rods 111 by the air stream, and the less the associated noise will be generated.

Specifically, referring to FIG. 2 of the drawings, each of the connecting rods 111 is shaped and size to form an arch shape with respect to a longitudinal axis of the air purifier. As such, the total cross sectional surface area through which the air flows is approximately 25% more than that of a structure where the connecting rods 111 do not have the arch contour. The maximization of the total cross sectional surface area through which the air flows has the effect of minimizing noise.

Referring to FIG. 2, FIG. 10 and FIG. 11 of the drawings, the air output arrangement 11 further comprises a main panel 113 and a peripheral panel 114, wherein the main panel 113 has a substantially circular cross-sectional shape and is position on top of the outer case 10. The motor 60 and the air guiding device 50 are supported by the main panel 113. In other words, the motor 60 and the air guiding device 50 are directly or indirectly connected to the main panel 113. The air output arrangement 11 further comprises an outer ring 114 spaced apart from the main panel 113 and is connected to the outer case 10, wherein the connecting rods 111 extend between the main panel 113 and the outer ring 114. The connecting rods 111 are securely positioned between the main panel 113 and the outer ring 114 in such a manner that each of the air outlets 112 corresponds to a position of a corresponding second fan blade 54 so as to maximize the efficiency of air being discharged out of the air purifier and at the same time the air output arrangement 11 is connected to the outer case 10 so that the main panel 113 can be utilized to support the motor 60, the air guiding device 50 and the driving fan 30.

According to the preferred embodiment of the present invention, and referring to FIG. 2 of the drawings, the outer case 10 further comprise a first partitioning wall 70 provided in the driving cavity 16 at a position between the air hub 40 and the outer boundary member 53. Specifically, the first partitioning wall 70 extends between the peripheral frame 43 and the outer boundary member 53 and is supported by the peripheral frame 43. As such, the air driven by the driving fan 30 can be concentrated in the region between the driving fan 30 and the first partitioning wall 70, which is arranged to guide the air to enter the second fan blades 54. The first partitioning wall 70 is configured to be inclinedly mounted in the driving cavity 16 and has a bottom curved portion positioned in a vicinity of the first fan blades 33. This arrangement can facilitate secure connection between the first partitioning wall 70 and the peripheral frame 43, and also facilitate smooth passage of air in the region between the driving fan 30 and the first partitioning wall 70 so as to minimize air friction and noise.

Referring to FIG. 2 of the drawings, the outer case 10 further comprise a second partitioning wall 80 and a third partitioning wall 90 provided in the driving cavity 16. The second partitioning wall 80 is positioned between the outer boundary member 53 and the outer ring 114. The third partitioning wall 90 is positioned between the inner boundary member 52 and the main panel 113. The second partitioning wall 80 and the third partitioning wall 90 are configured to form a tubular structure and they are coaxially arranged with respect to each other. Air from the second fan blades 54 are guided to flow into the region between the second partitioning wall 80 and the third partitioning wall 90 and eventually reach the air outlets 112. As such, air flowing from the second fan blades 54 can be effectively guided by the second partitioning wall 80 and the third partitioning wall 90 to reach the air outlets 112 so as to maximize air flow efficiency.

Figure 12:
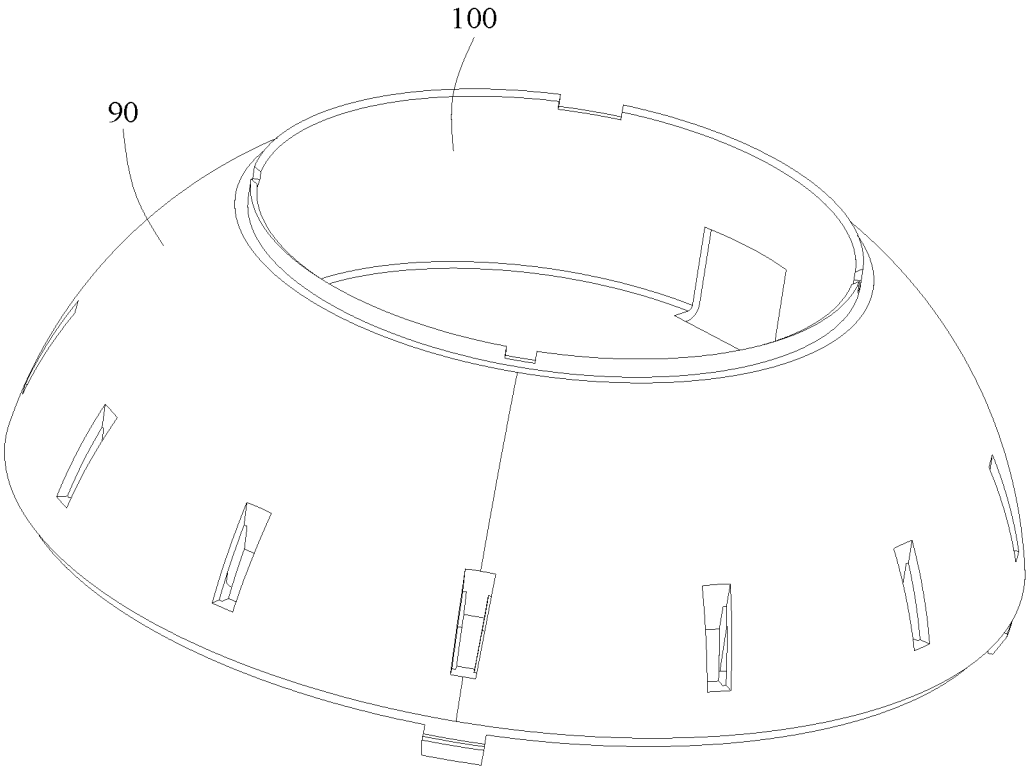
FIG. 12 is a schematic diagram of a third partitioning wall and a coupling member of the air purifier as shown in FIG. 2.

Referring to FIG. 2 and FIG. 12 of the drawings, each of the third partitioning wall 90 and the second partitioning wall 80 is configured to have a curved and convex contour, wherein an internal diameter of the third partitioning wall 90 gradually increases from the main panel 113 toward the inner boundary member 52 so as to allow air flowing from the second fan blades 54 to flow toward the air outlets 112 in a smoother manner for minimizing noise.

Referring to FIG. 2 and FIG. 12 of the drawings, the outer case 10 further comprises a coupling member 100 provided at a space surrounded by the third partitioning wall 90 around the center portion. The coupling member 10 has an indention and is mounted on the main panel 113. The third partitioning wall 90, the coupling member 100, the inner boundary member 52 and the mounting portion 51 together form a mounting cavity, wherein the motor 60 is mounted in the mounting cavity. The coupling member 100 is equipped with an installation port, wherein the motor is connected to the installation port. The installation port is also connected to the mounting portion 51.

According to the preferred embodiment of the present invention, and referring to FIG. 1 and FIG. 2 of the drawings, the outer case 10 comprises a first tubular member 12, a second tubular member 13, and a base 14, wherein the first tubular member 12 is overlapped on the second tubular member 13 in a coaxial manner. The first tubular member 12 is provided outside the first partitioning wall 70 and the second partitioning wall 80. The outer ring 114 is connected to the first tubular member 12 at a position opposite to the second tubular member 13. The second tubular member 13 is provided outside the filter 20. The base 14 is provided on the second tubular member 13 at a position opposite to the first tubular member 12. Thus, the base 14 is provided at a lower end of the filter 20 at a position opposite to the driving fan 30. The second tubular member 13 has a plurality of the air inlets 17 formed thereon.

The present invention, while illustrated and described in terms of a preferred embodiment and several alternatives, is not limited to the particular description contained in this specification. Additional alternative or equivalent components could also be used to practice the present invention.

What is claimed is:

1. An air purifier, comprising:

an outer case having at least one air inlet, a filtering cavity and a driving cavity space apart from each other;

a filter which has a central cavity and is received in said filtering cavity, said air inlet of said outer case communicating said filter with ambient environment;

a driving fan received in said driving cavity;

an air hub, air filtered by said filter and in said filtering cavity being arranged to enter said driving cavity through said air hub, said air hub comprising a first air drawing frame and a second air drawing frame, said first air drawing frame extending within said central cavity of said filter and being coaxially formed with respect to said filter, an axial direction of said first air drawing frame being aligned with a longitudinal axis of said driving fan, said second air drawing frame peripherally, upwardly and radially extending from said first air drawing frame toward an upper end of said filter, each of said first air drawing frame and said second air drawing frame having a plurality of air inlets evenly formed and distributed thereon, said first air drawing frame being configured as having a flat surface and substantially perpendicular to a longitudinal axis of said filter, said second air drawing frame being configured to have form a cone-shape structure, in which a diameter of this cone-shape structure gradually increases from said first air drawing frame; said second air drawing frame forming an angle of inclination with respect to said filter, said angle of inclination ranges between 15° is 45°, a vertical distance between said first air drawing frame and a top end of said filter is between 35 mm to 65 mm; and an air output arrangement communicated with said driving cavity so as to allow air in said driving cavity to be discharged out of said driving cavity through said air output arrangement.

2. The air purifier, as recited in claim 1, wherein said air purifier further comprises an air guiding device provided in said driving cavity and positioned between said driving fan and said air output arrangement, said air guiding device being coaxially arranged with respect to said driving fan, said driving fan being configured as a centrifugal fan and comprises a plurality of first fan blades, said air guiding device comprising a plurality of second fan blades spirally distributed along said air guiding device.

3. The air purifier, as recited in claim 2, wherein in that a direction of spiral of each of said second fan blades is opposite to that of said first fan blades.

4. The air purifier, as recited in claim 2, wherein an external diameter of said first fan blades of said driving fan is smaller than an internal diameter of said second fan blades.

5. The air purifier, as recited in claim 2, wherein said air guiding device comprises a mounting portion for mounting said air guiding device in said outer case, an inner boundary member extended from said mounting portion, and an outer boundary member extended from said mounting portion at a position radially outwardly from said inner boundary member, wherein said second fan blades extend between said inner boundary member and said outer boundary member.

6. The air purifier, as recited in claim 5, wherein each of said second fan blades extends from said inner boundary member at a position near said corresponding first fan blade toward said outer boundary member in a curved manner such that a curvature extends toward a direction opposite to the adjacent second fan blade, said second fan blade extending from said outer boundary member towards said inner boundary member in a curved manner such that a curvature extends toward a direction opposite to said adjacent second fan blade.

7. The air purifier, as recited in claim 6, wherein each of said second fan blades extends from said inner boundary member toward said outer boundary member in a curved manner.

8. The air purifier, as recited in claim 2, wherein said air purifier further comprises a motor for driving said first fan blades to rotate, wherein a direction of rotation of said motor is opposite to a curvature direction of said first fan blades.

9. The air purifier, as recited in claim 5, wherein said driving fan further comprises a supporting frame and a circumferential frame, said supporting frame and said circumferential frame being coaxially arranged and spacedly supported from each other, an external contour of a top portion of said supporting frame being corresponding to a bottom portion of said mounting portion, each of said first fan blades being mounted between said supporting frame and said circumferential frame.

10. The air purifier, as recited in claim 9, wherein said air output arrangement comprises a plurality of connecting rods spirally distributed on top of said outer case, wherein a spiral distribution and orientation of said connecting rods are corresponding to that of said second fan blades, a space formed between each two connecting rods constituting an air outlet of said air purifier.

11. The air purifier, as recited in claim 10, wherein each of said connecting rods is shaped and size to form an arch shape.

12. The air purifier, as recited in claim 11, wherein said air output arrangement further comprises a main panel and a peripheral panel, wherein said motor and said air guiding device are supported by said main panel, said connecting rods extending between said main panel and said outer ring.

13. The air purifier, as recited in claim 12, wherein said outer case further comprises a first partitioning wall provided in said driving cavity at a position between said air hub and said outer boundary member, said air driven by said driving fan is concentrated in a region between said driving fan and said first partitioning wall, which is arranged to guide said air to enter said second fan blades.

14. The air purifier, as recited in claim 13, wherein said outer case further comprise a second partitioning wall and a third partitioning wall provided in said driving cavity, said second partitioning wall being positioned between said outer boundary member and said outer ring, said third partitioning wall being positioned between said inner boundary member and said main panel, air from said second fan blades being guided to flow into a region between said second partitioning wall and said third partitioning wall and eventually flow out of said outer case through said air outlets.

15. The air purifier, as recited in claim 14, wherein said third partitioning wall is configured to have a curved and convex contour, wherein an internal diameter of said third partitioning wall gradually increases from said main panel toward said inner boundary member.

16. The air purifier, as recited in claim 14, wherein said outer case further comprises a first tubular member, a second tubular member, and a base, wherein said first tubular member is overlapped on said second tubular member in a coaxial manner, said first tubular member being provided outside said first partitioning wall and said second partitioning wall, said second tubular member being provided outside said filter, said base being provided on said second tubular member at a position opposite to said first tubular member, said air inlets being formed on said second tubular member.

* * * * *